US011435101B2

(12) United States Patent
Branson et al.

(10) Patent No.: US 11,435,101 B2
(45) Date of Patent: Sep. 6, 2022

(54) AIR MOVER REFRIGERANT LEAK DETECTION AND RISK MITIGATION

(71) Applicant: Rheem Manufacturing Company, Atlanta, GA (US)

(72) Inventors: Michael W. Branson, Fishers, IN (US); Sivakumar Gopalnarayanan, Plano, TX (US)

(73) Assignee: RHEEM MANUFACTURING COMPANY, Atlanta, GA (US)

( * ) Notice: Subject to any disclaimer, the term of this patent is extended or adjusted under 35 U.S.C. 154(b) by 169 days.

(21) Appl. No.: 16/583,956

(22) Filed: Sep. 26, 2019

(65) Prior Publication Data

US 2021/0095876 A1 Apr. 1, 2021

(51) Int. Cl.
*F24F 11/36* (2018.01)
*F24F 1/0018* (2019.01)

(52) U.S. Cl.
CPC ..... *F24F 11/36* (2018.01); *F24F 1/0018* (2013.01)

(58) Field of Classification Search
CPC ..... F24F 11/36; F24F 1/0018; F24F 11/83; F24F 1/0007; F24F 11/79; F25B 2500/222; F25B 2500/221
See application file for complete search history.

(56) References Cited

U.S. PATENT DOCUMENTS 4,295,028 A * 10/1981 Tanabe ..... F24C 7/08 219/490
6,085,531 A * 7/2000 Numoto ..... F25B 49/005 62/149
2013/0098576 A1* 4/2013 Fujitaka ..... F24F 1/0007 165/11.1
2015/0233622 A1* 8/2015 Yajima ..... F25B 49/005 62/129
2016/0146488 A1* 5/2016 Ochiai ..... F25B 13/00 62/125
2016/0348933 A1* 12/2016 Takeuchi ..... F24F 11/83
2016/0370809 A1* 12/2016 Miller ..... G01F 1/68
2017/0198936 A1* 7/2017 Yamaguchi ..... F25B 49/02
2018/0259235 A1* 9/2018 Delgoshaei ..... F25B 49/02
2018/0283725 A1* 10/2018 Ikawa ..... F24F 1/0047
2019/0170599 A1* 6/2019 Kester ..... G01M 3/22
(Continued)

FOREIGN PATENT DOCUMENTS

JP 2001336841 * 12/2001
JP 2002115939 * 4/2002
WO WO-2019162993 A1 * 8/2019 ..... F24F 1/0018

*Primary Examiner* — Frantz F Jules
*Assistant Examiner* — Martha Tadesse
(74) *Attorney, Agent, or Firm* — Eversheds Sutherland (US) LLP

(57) ABSTRACT

An air mover system for use in an indoor unit of a heating, ventilation, and air conditioning (HVAC) system includes a blower comprising a motor and a blower control unit configured to control operations of the motor. The blower control unit includes a controller and a sensor communicably coupled to the controller. The sensor is configured to sense air inside the indoor unit and to provide sensor information to the controller. The controller is configured to determine whether a refrigerant is present in the air based on the sensor information and to control the blower to move the air out of the indoor unit in response to determining that the refrigerant is present in the air.

15 Claims, 8 Drawing Sheets

(56) References Cited

U.S. PATENT DOCUMENTS

| | | | | |
|---|---|---|---|---|
| 2019/0170600 | A1 | 6/2019 | Tice et al. | |
| 2019/0170603 | A1* | 6/2019 | Gupte | F25B 49/005 |
| 2019/0170604 | A1* | 6/2019 | Kester | F25B 49/005 |
| 2019/0331377 | A1* | 10/2019 | Matsuda | F24F 11/36 |
| 2020/0124305 | A1* | 4/2020 | Goel | F24F 11/88 |
| 2020/0141601 | A1* | 5/2020 | Weinert | F24F 1/0041 |
| 2020/0318875 | A1* | 10/2020 | Yamada | F25B 6/02 |

* cited by examiner

AIR MOVER REFRIGERANT LEAK DETECTION AND RISK MITIGATION

TECHNICAL FIELD

The present disclosure relates generally to heating, ventilation, and air conditioning (HVAC) systems, and more particularly to refrigerant leak detection and the reduction of leaked refrigerant concentration.

BACKGROUND

HVAC systems are typically used for managing the temperature of spaces inside structures such as residential and commercial buildings. An HVAC system may be used to heat and/or cool a space. An HVAC system that can operate in a cooling mode is typically a closed refrigerant circulation system, and a refrigerant is circulated through the HVAC system during cooling operations. A refrigerant leak may sometimes occur in an HVAC system. For example, a refrigerant leak can occur in an indoor unit of an HVAC system. A build-up of leaked refrigerant in the indoor unit may be undesirable for a number of reasons, such as fire risks, risk from toxins at high concentrations. For example, a refrigerant used in an HVAC system may be flammable. Thus, a solution that enables effective detections of a leaked refrigerant and the dissipation of the leaked refrigerant may be desirable.

SUMMARY

The present disclosure relates generally to heating, ventilation, and air conditioning (HVAC) systems, and more particularly to refrigerant leak detection and the reduction of leaked refrigerant concentration. In some example embodiments, an air mover system for use in an indoor unit of a heating, ventilation, and air conditioning (HVAC) system includes a blower comprising a motor and a blower control unit configured to control operations of the motor. The blower control unit includes a controller and a sensor communicably coupled to the controller. The sensor is configured to sense air inside the indoor unit and to provide sensor information to the controller. The controller is configured to determine whether a refrigerant is present in the air based on the sensor information and to control the blower to move the air out of the indoor unit in response to determining that the refrigerant is present in the air In another example embodiment, an indoor unit of a heating, ventilation, and air conditioning (HVAC) system includes a coil and a blower that includes a motor. The blower draws in or pushes air past the coil during a cooling operation of the HVAC system. The indoor unit further includes a blower control unit configured to control operations of the motor. The blower control unit includes a controller and a sensor communicably coupled to the controller. The sensor is configured to sense air inside the indoor unit and to provide sensor information to the controller. The controller is configured to determine whether a refrigerant is present in the air based on the sensor information and to control the blower to move the air out of the indoor unit.

In another example embodiment, a heating, ventilation, and air conditioning (HVAC) system includes an outdoor unit and an indoor unit fluidly coupled to the outdoor unit. The indoor unit includes a coil and a blower that includes a motor. The blower draws in or pushes air past the coil during a cooling operation of the HVAC system. The indoor unit further includes a blower control unit configured to control operations of the motor. The blower control unit includes a controller and a sensor communicably coupled to the controller. The sensor is configured to sense air inside the indoor unit and to provide sensor information to the controller. The controller is configured to determine whether a refrigerant is present in the air based on the sensor information and to control the blower to move the air out of the indoor unit.

These and other aspects, objects, features, and embodiments will be apparent from the following description and the appended claims.

BRIEF DESCRIPTION OF THE DRAWINGS

Reference will now be made to the accompanying drawings, which are not necessarily drawn to scale, and wherein.

Figure 1:
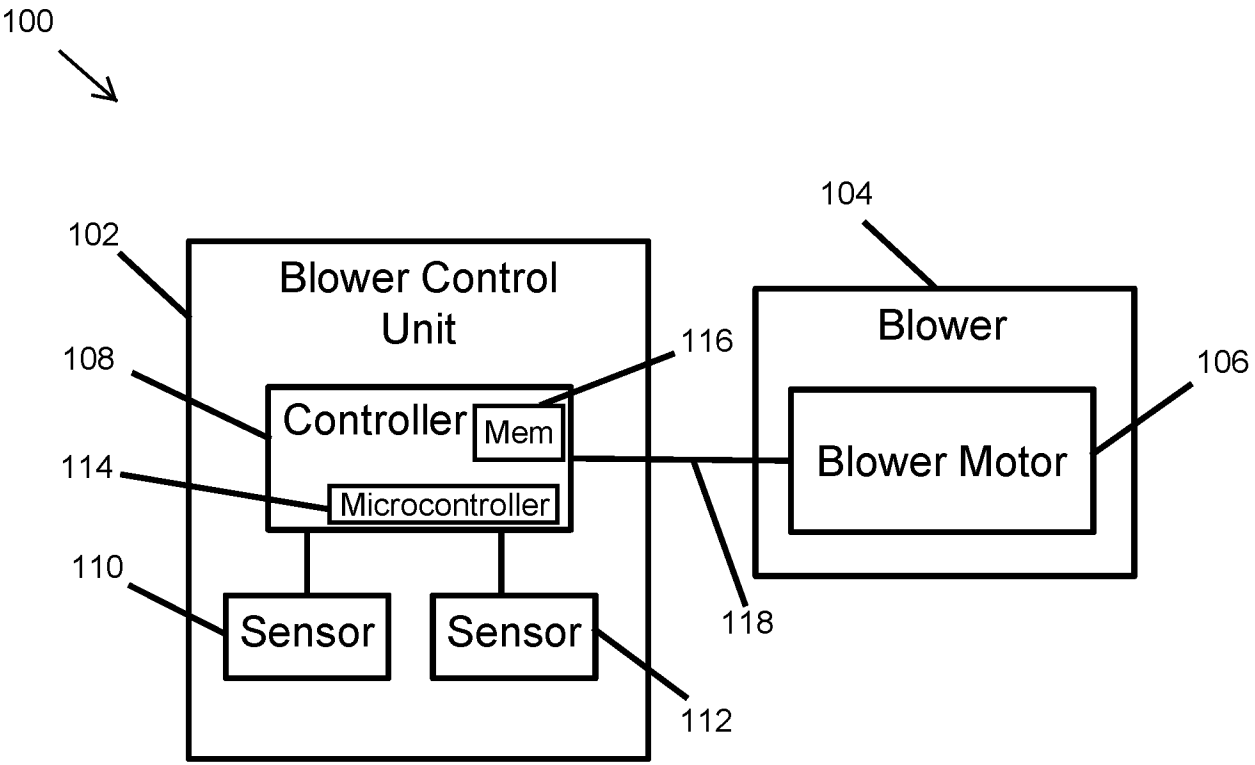
FIG. 1 illustrates an air mover system of an indoor unit of an HVAC system according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, the same reference numerals that are used in different drawings may designate like or corresponding but not necessarily identical elements.

DETAILED DESCRIPTION OF EXAMPLE EMBODIMENTS

In the following paragraphs, example embodiments will be described in further detail with reference to the figures. In the description, well-known components, methods, and/or processing techniques are omitted or briefly described. Furthermore, reference to various feature(s) of the embodiments is not to suggest that all embodiments must include the referenced feature(s).

Turning now to the figures, particular example embodiments are described. FIG. 1 illustrates an air mover system 100 of an indoor unit of an HVAC system according to an example embodiment. In some example embodiments, the air mover system 100 may operate to circulate air through a space, such as a room or a house, that is air conditioned (i.e., cooled and/or heated) by an HVAC system. For example, the air mover system 100 may suck/draw in air from an air conditioned area into an indoor unit of an HVAC system and may blow the air out of the indoor unit back into the air conditioned area. The indoor unit may be fluidly connected to the air conditioned area via one or more ducts. Alternatively, the indoor unit may be directly connected to the air conditioned area. The air that is circulated through the indoor unit may be cooled or heated depending on whether the HVAC system is operating in a cooling or heating mode. In some cases, the air mover system 100 may suck air into the indoor unit and blow the air out of the indoor unit to circulate air without the air necessarily being cooled or heated. For example, the air may simply be filtered as the air passes through the indoor unit.

In some example embodiments, the air mover system 100 includes a blower controller unit 102 and a blower 104 that includes a blower motor 106. For example, the blower motor 106 may be an electronically commutated (EMC) motor. The blower controller unit 102 may be connected to the blower 104 by an electrical connection 118. For example, the electrical connection 118 may include one or more electrical wires and/or one or more electrical connectors.

In some example embodiments, the blower controller unit 102 may be physically separated from the blower 104 except for one or more electrical connections such as the connection 118. Alternatively, the blower controller unit 102 may be physically attached to and/or integrated in the blower 104. In general, the blower controller unit 102 and the blower 104 may be positioned in suitable relative locations with respect to each other without departing from the scope of this disclosure.

In some example embodiments, the blower controller unit 102 may include a controller 108 and a sensor 110. The blower controller unit 102 may also include a sensor 112 that may be the same as or a different type of sensor than the sensor 110. The controller 108 may include a microcontroller 114 (or a microprocessor), a memory device 116 (e.g., a flash memory, a static random access memory, etc.), and other components, such a digital-to-analog converter, amplifier, etc. To illustrate, the microcontroller 114 of the controller 108 may execute a software code stored in the memory device 116 to perform some of the operations described herein with respect to the blower controller unit 102.

In some example embodiments, the sensor 110 may sense the air for an element that indicates the presence or absence of a refrigerant in the air. For example, the sensor 110 may be a refrigerant sensor that senses the air for the presence of a particular refrigerant. Alternatively, the sensor 110 may sense the air for one or more other elements that may indicate the presence or absence of a refrigerant in the air. For example, the sensor 110 may be an oxygen sensor, where oxygen levels below a threshold level may indicate the presence of a refrigerant in the air. The sensitivity of the sensor 110 may be set/adjusted such that the sensor 110 can sense the refrigerant when the refrigerant is present in the indoor unit at a particular concentration.

In some example embodiments, the sensor 110 may be coupled to the controller 108 via one or more electrical wires or traces. The sensor 110 may provide sensor information to the controller 108 indicating whether a refrigerant or another element indicative of the presence of a refrigerant is sensed by the sensor 110. The controller 108 and the sensor 110 may be attached to the same circuit board and may be electrically connected via one or more wire traces and/or wires. Alternatively, the controller 108 and the sensor 110 may be attached to separate circuit boards that are attached to each other, for example, using connectors. In some alternative embodiments, the sensor 110 may be attached to a flexible arm mount that is attached to circuit board that includes the controller 108. For example, the flexible arm mount may allow the sensor 110 to be moved and oriented for more effective sensing. The flexible arm may also provide a wireway for the one or more electrical wires to extend therethrough between the sensor 110 and the circuit board that includes the controller 108.

In some example embodiments, the blower controller unit 102 may control the operations of the blower 104 using one or more control signals that are provided to the blower motor 106 via the electrical connection 118. The blower controller unit 102 may control the powering on and off of the blower motor 106 and the rotational direction of the blower motor 106. To illustrate, the blower controller unit 102 may control the rotational direction of the blower motor 106 to control the direction of air flow through the indoor unit. For example, the blower motor 106 may control the polarity of the voltage provided to the blower motor 106 to control the rotational direction of the blower motor 106. The blower 104 may blow air in one direction when the blower motor 106 rotates in a clockwise direction and may blow air in an opposite direction when the blower motor 106 rotates in a counter-clockwise direction.

In some example embodiments, the blower controller unit 102 may control the operations of the blower 104 based on the sensor information from the sensor 110. To illustrate, the controller 108 may receive the sensor information and determine whether the sensor information indicates the presence (or absence) of a refrigerant in the air sensed by the sensor 110. If the controller 108 determines that a refrigerant is present in the air sensed by the sensor 110, the controller 108 may control the blower motor 106 such that the blower 104 blows the air to dissipate the refrigerant. For example, the controller 108 may power on the blower motor 106 to turn on the blower 104.

In some example embodiments, the controller 108 may control the blower motor 106 such that the blower 104 blows air at a slower air flow rate (e.g., half, $1/10^{th}$, etc.) than the air flow rate during regular circulation/heating/cooling operations. For example, the movement of air at a relatively slower air flow rate may improve the sensing of a leaked refrigerant or other elements by the sensor 110. The controller 108 may control the blower motor 106 to operate at a slower rate for a sensing time period (e.g., 30 seconds, 1 minute, etc.) that allows the sensor 110 to effectively sense the air for a refrigerant or other elements. The sensing time period may depend on a number of factors including the type of the sensor 110, the capacity of the blower motor 106, the type of the refrigerant, etc.

In some example embodiments, the controller 108 may also control the blower motor 106 to operate at a slower rate, for example, at a regular sensing time interval and/or based on one or more events (e.g., the HVAC system is turned on after being idle, the HVAC system has been running for a timer period, etc.), a user input, etc. For example, the controller 108 may control the blower motor 106 to operate at a slower rate for the sensing time period at a sensing time interval of 30 minutes, 1 hour, 4 hours, 8 hours, 12 hours, or another desired time interval. The particular sensing time interval may depend on a number of factors including the type of refrigerant, the age of the indoor unit, etc. as can be readily understood by those of ordinary skill in the art with the benefit of this disclosure.

In some example embodiments, the controller 108 can control the blower motor 106 such that the blower 104 blows air in a forward or reverse direction. For example, the controller 108 may control the blower motor 106 such that the blower 104 blows air in an opposite (i.e., reverse) direction from the direction of air flow that exists during regular circulation/heating/cooling operations. To illustrate, the blower control unit 102, including the sensor 110, may be located in an indoor unit of an HVAC system such the direction of air flow during regular circulation/heating/cooling operations moves leaked refrigerant away from the sensor 110. For example, the source of the leaked refrigerant may be a coil that is in the indoor unit. To enable the sensor 110 to effectively sense the air in the indoor unit, the controller 108 may control the blower 104 such that the air in the indoor unit flows toward the sensor 110, which may be an opposite direction from the direction of air flow during regular circulation/heating/cooling operations.

As described above, the controller 108 may control the blower motor 106 such that the blower 104 blows air in a reverse direction toward the blower control unit 102 at a slower air flow rate than the air flow rate that exists during regular circulation/heating/cooling operations. As described above, the controller 108 may control the blower motor 106 such that the blower 104 blows air toward the blower control unit 102 for the sensing time period and at the regular sensing time interval and/or based on one or more events, a user input, etc.

In some example embodiments, the sensor 112 may include a sensor that senses a refrigerant or another element in the air (e.g., oxygen level) that is indicative of the presence or absence of refrigerant in the air. For example, the sensor 110 and the sensor 112 may be attached to the same circuit board but may be at different locations from each other to provide a more effective sensing of refrigerant or another element in the air. The sensor 112 may provide sensing information to the controller 108, and the controller 108 may control the blower 104 in a similar manner as described with respect to the sensor 110.

In some alternative embodiments, the sensor 112 may include an indoor quality sensor, such as a temperature sensor, a humidity sensor, a carbon dioxide sensor, a smoke sensor, a volatile organic compound sensor, etc. For example, the controller 108 may receive sensing information from the sensor 112 and determine relevant information (e.g., temperature, humidity, etc.) indicated by the sensor information. The controller 108 may transmit the information determined from the sensor to a user and/or to another component (e.g., a main controller unit of the HVAC system). Alternatively or in addition, the controller 108 may transmit the sensor information to a user and/or to another component without processing sensor information.

Because the blower control unit 102 includes the controller 108 and the sensor 110, the blower control unit 102 can reliably and quickly control the operations of the blower 104 to mitigate risks associated with refrigerant leaks in an indoor unit of an HVAC system. To illustrate, because the controller 108 controls the blower motor 106 at least based on sensor information from the sensor 110, risks associated with errors during HVAC system installations and with wiring defects and damages may be reduced by having because the blower control unit 102 include the controller 108 as well as the sensor 110. Locating other sensors, such as the sensor 112, at the blower control unit 102 may further reduce risks associated with installation errors and wiring defects/damages.

In some alternative embodiments, the air mover system 100 may include other components without departing from the scope of this disclosure. For example, the air mover system 100 may include components for providing power to the blower control unit 102 and the blower 104. In some example embodiments, blower control unit 102 may include other components and may interface with other components without departing from the scope of this disclosure. In some example embodiments, the controller 108 may include components other than shown without departing from the scope of this disclosure. In some example embodiments, the sensor 110 may include multiple sensors that sense the same or different elements in the air. In some alternative embodiments, the sensor 112 may be omitted or integrated with the sensor 110. In some alternative embodiments, the sensor 112 may be remotely located from the blower control unit 102 and may provide sensor information to the blower control unit 102 via a wired connection or wirelessly (e.g., Bluetooth, etc.).

Figure 2:
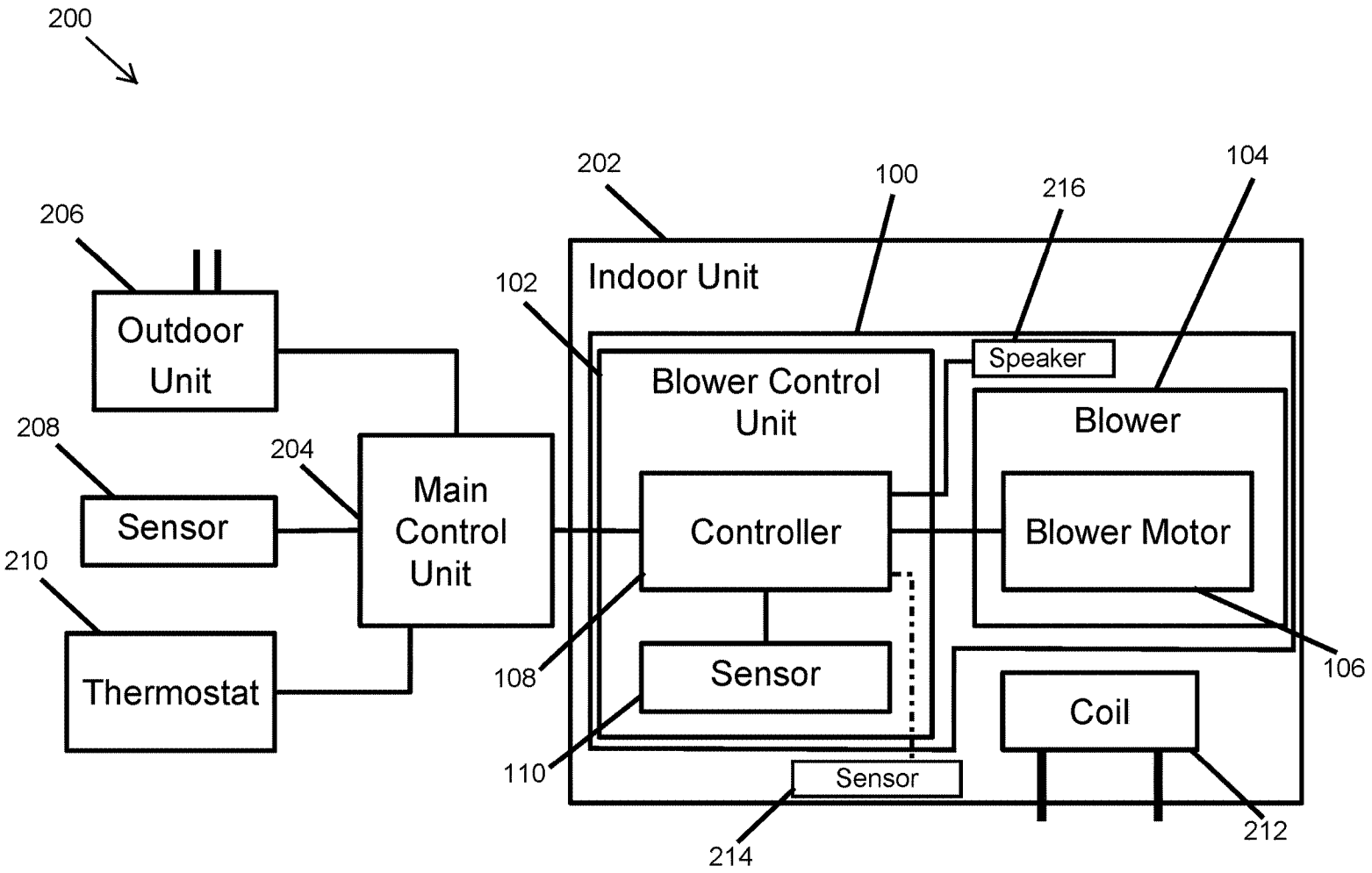
FIG. 2 illustrates an HVAC system including an indoor unit that includes the air mover system of FIG. 1 according to an example embodiment.

FIG. 2 illustrates an HVAC system 200 including an indoor unit 202 that includes the air mover system 100 of FIG. 1 according to an example embodiment. The HVAC system is shown Referring to FIGS. 1 and 2, in some example embodiments, the HVAC system 200 includes the indoor unit 202, a main control unit/board 204, an outdoor unit 206, a sensor 208, and a thermostat 210. Typically, the indoor unit 202 is located inside a building and the outdoor unit 206 is located outside the building. In some cases, one or more components of the indoor unit 202 may be located outside a building, and one or more components of the outdoor unit 206 may be located inside a building.

In some example embodiments, the main control unit 204 may be in communication with the outdoor unit 206, the sensor 208, and the thermostat 210 as well as with the controller 108 of the air mover system 100. The main control unit 204 may include a microcontroller or microprocessor, a memory device (e.g., a flash memory, a static random access memory, etc.), and other components, such an analog-to-digital converter, amplifier, etc. To illustrate, the main control unit 204 may execute a software code stored in the memory device to perform some of the operations described herein with respect to the main control unit 204.

In some example embodiments, the outdoor unit 206 may include a compressor, a coil, etc. as can be readily understood by those of ordinary skill in the art with the benefit of this disclosure. For example, the coil of the outdoor unit 206 may operate as a condenser when the HVAC system 200 is an air conditioning system or when HVAC system 200 is a heat pump system operating in a heating mode. The main control unit 204 may receive information from the outdoor unit 206 and may also control the outdoor unit 206. For example, the main control unit 204 may control the powering on and off the compressor of the outdoor unit 206 and may receive status and other information from the outdoor unit 206.

In some example embodiments, the sensor 208 may include one or more sensors that sense parameters such air temperature as well as refrigerant temperature, refrigerant pressure, etc. For example, the sensor 208 may provide sensor information to the main control unit 204, and the main control unit 204 may control other system components (e.g., the compressor in the outdoor unit) based on the sensor information. Alternatively or in addition, the main control unit 204 may provide the sensor information to another system component (e.g., the controller 108).

In some example embodiments, the thermostat 210 may be located in a space that is air conditioned by the HVAC system 200. The main control unit 204 may control cooling and/or heating operations of the HVAC system 200 based on the thermostat 210. To illustrate, the main control unit 204 may control the indoor unit 202 as well as the outdoor unit 206 based on the indication from the thermostat 210 whether heating or cooling of a space is needed. For example, the main control unit 204 may communicate with the controller 108 to power on and power off the blower 104.

In some example embodiments, the indoor unit 202 may include the air mover system 100, a coil 212, and optionally a sensor 214. The air mover system 100 may operate as described with respect to FIG. 1. The air mover system 100 may include the blower control unit 102 and the blower 104. The air mover system 100 may also include an annunciator 216 for providing, for example, audio notifications. To illustrate, the air mover system 100 may provide an audio notification of the detection of a refrigerant and/or other information via the annunciator 216. Alternatively or in addition, the air mover system 100 may transmit, wirelessly or via a wired connection, a notification of the detection of a refrigerant and/or other information. The coil 212 may function as an evaporator when the HVAC system 200 is an air conditioning system or a heat pump system operating in a cooling mode. The coil 212 may function as a condenser when the HVAC system 200 is a heat pump system operating in a heating mode. In general, the coil 212 and refrigerant pipe joints to the coil 212 may be the primary sources of refrigerant leakage inside the indoor unit 202.

In some example embodiments, the sensor 214, when present, may operate in a similar manner as the sensor 110. For example, the sensor 214 may sense a refrigerant or an air element indicative of the presence of a refrigerant in the air inside the indoor unit 202. The sensor 214 may be located close to the coil 212, at another location inside the indoor unit 202, or outside of the indoor unit 202. The sensor 214 may provide to the controller 108 sensor information indicative of the presence or absence of a refrigerant or another air element wirelessly or via a wired connection (shown as a dotted line), and the controller 108 may take steps based on the sensor information as described with respect to FIG. 1 and the sensor 110. For example, if the controller 108 determines that the sensor information from the sensor 110 or from the sensor 214 indicates the presence of a refrigerant (e.g., any amount of refrigerant or an amount exceeding a threshold), the controller 108 may activate the blower 104 such that the blower 104 blows the leaked refrigerant in the air out of the indoor unit 202 into the air conditioned space to dissipate the leaked refrigerant. The controller 108 may also provide an audio notification (e.g., recorded message, beeps, etc.) via the annunciator 216 to indicate the detection of the refrigerant by the sensor 110, 214. In some alternative embodiments, the sensor 214 may be located outside of the indoor unit 202 without departing from the scope of this disclosure. For example, the sensor 214 may be located at or near a likely source of a refrigerant leak in the HVAC system 200 outside of the indoor unit 202. In such cases, the controller 108 may provide an audio notification of the detection of leaked refrigerant without activating or changing the operation of the blower 104.

In some example embodiments, the controller 108 may control the blower 104 such that the blower 104 blows the air, including the leaked refrigerant, out of the indoor unit 202 for a dissipation time period (e.g., 5 minutes). After the dissipation time period, the controller 108 may again control the motor 106 (e.g., for air flow direction and/or rate) such that the air is sensed by the sensor 110 for the refrigerant or an element indicative of the refrigerant. If the controller 108 determines that the sensor information indicates the presence of the refrigerant, the control 108 may repeat the process of controlling the blower 104 to dissipate the air including the leaked refrigerant into the air conditioned area.

In some example embodiments, as described above with respect to FIG. 1, the controller 108 may control the blower 104 to move the air out of the indoor unit 202 in response to determining that the information from the sensor 110 indicates the presence of a refrigerant in the air inside the indoor unit 202. The controller 108 may also indicate to the main control unit 204 the detection of the refrigerant, and the main control unit 204 may control the outdoor unit 206 to stop cooling or heating related operations of the outdoor unit 206. For example, the main control unit 204 may shut off the compressor in the outdoor unit 206. Thus, in some example embodiments, the controller 108 may control blower 104 to blow/move the air out of the indoor unit 202 and control, indirectly through the main control unit 204, the compressor in the outdoor unit 206 to stop cooling and/or heating operations of the HVAC system 200.

In some alternative embodiments, the HVAC system 200 may include other components than shown without departing from the scope of this disclosure. In some example embodiments, the main control unit 204 may be attached to or included the indoor unit 202 without departing from the scope of this disclosure. In some alternative embodiments, the indoor unit 202 may include other components than shown without departing from the scope of this disclosure. In some alternative embodiments, one or more components of the system 200 may be omitted without departing from the scope of this disclosure. For example, the sensor 208, the sensor 214, and/or the annunciator 216 may be omitted without departing from the scope of this disclosure.

Figure 3:
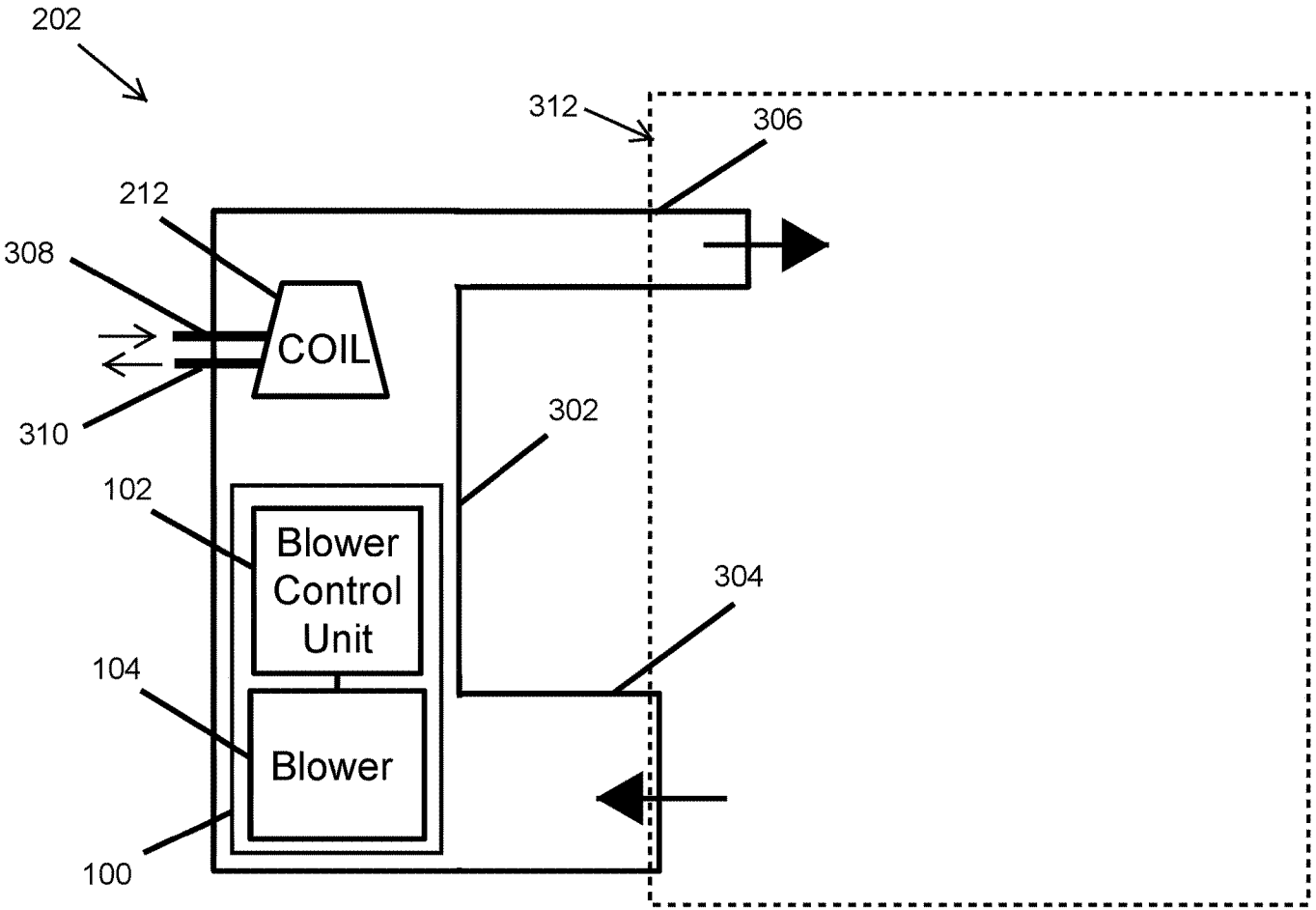
FIG. 3 illustrates the indoor unit of FIG. 2 including the air mover system according to an example embodiment.

FIG. 3 illustrates the indoor unit 202 of FIG. 2 including the air mover system 100 according to an example embodiment. Referring to FIGS. 1-3, in some example embodiments, the indoor unit 202 may include a housing 302 that houses the air mover system 100 and the coil 212. The coil 212 may be coupled to refrigerant pipes 308, 310. For example, the pipe 308 may carry a refrigerant to the coil 212, and the pipe 310 may carry the refrigerant from the coil.

In some example embodiments, the housing 302 may be coupled to a return air duct 304 and to an outflow duct 306. For example, the air in a space that is air conditioned by the HVAC system 200 may flow into the indoor unit 202 through the intake duct 304 and flow back to the space through the outflow duct 306 after pass by the coil 212. The air may also be filtered inside the indoor unit 202 before flowing out through the outflow duct 306.

As shown in FIG. 3, in some example embodiments, the coil 212 may be positioned above the air mover system 100 including the blower control unit 102 and the blower 104. For example, when operating in cooling, heating, and air circulating modes, the blower 104 may suck in air through the intake duct 304 and blow the air out through the outflow duct 306, where the air blown by the blower 104 passes by the coil 212. When operating in a cooling or heating mode, the air that passes by the coil 212 may be cooled or heated by the coil 212 by virtue of the refrigerant flowing through the coil 212.

In some cases, the air inside the indoor unit 202 may include a refrigerant from a leak, for example, in the coil 212. When the HVAC system 200 is not actively operating to heat or cool a space during relatively short or long time periods, the blower 104 may not blow the leaked refrigerant in the air away from the coil 212 and through the outflow duct 306 to dissipate the refrigerant into an air conditioned space 312 (e.g., a room/rooms, etc.). In such cases, the leaked refrigerant in the air may flow towards the blower control unit 102 that includes the sensor 110, and the sensor 110 may sense the refrigerant and provide to the controller 108 sensor information indicating the presence of the refrigerant. In response to determining that the sensor information indicates the presence of refrigerant in the air inside the indoor unit 202, the controller 108 may control (e.g., power on) the blower 104 to blow the air out of the indoor unit 202 through the outflow duct 306 to dissipate the refrigerant into the air conditioned space. The dissipation of the leaked refrigerant out of the indoor unit 202 may significantly reduce risks, such as the risk of fire if the refrigerant is flammable. The controller 108 may also provide a notification, for example, through the annunciator 216 indicating the detection of the refrigerant. The controller 108 may also control, directly or through the main control unit 204, the outdoor unit 206 to turn off or keep the outdoor unit 206 off in response to the detection of the refrigerant in the air inside the indoor unit 202. For example, in some cases, turning off the outdoor unit 206 or keeping the outdoor unit 206 off may reduce the amount of refrigerant leakage in the indoor unit 202.

In some example embodiments, because a leaked refrigerant that is in the air inside the indoor unit 202 may not flow from the leak location at or near the coil 212 toward the sensor 110 of the blower control unit 102, the blower control unit 102 may control the blower 104 to suck the air toward the sensor 110, which is an opposite (i.e., reverse) direction from the direction of air flow during normal heating and cooling operations. As described above with respect to FIG. 1, the blower control unit 102 may, for example, periodically or at different times, control the blower 104 to suck the air inside the indoor unit 202 toward the sensor 110. The blower control unit 102 may also control the blower 104 to suck the air, including any leaked refrigerant, inside the indoor unit 202 from the coil 212 toward the sensor 110 at a slower flow rate than the air flow rate during normal cooling or heating operations when the air is being blown from the blower 104 toward the coil 212. As described above, the blower control unit 102 may control the blower 104 to operate in a reverse air flow direction and/or at a lower speed/rate for a sensing time interval.

In some example embodiments, the indoor unit 202 may include other components without departing from the scope of this disclosure. In some example embodiments, the indoor unit 202 may be fluidly connected to the air conditioned area via one or more ducts. Alternatively, the indoor unit may be directly connected to the air conditioned area. In some alternative embodiments, the blower control unit 102 and the blower 104 may be in a different configuration or orientation than shown without departing from the scope of this disclosure. In some alternative embodiments, the intake duct 304 and the outflow duct 306 may be at different locations than shown without departing from the scope of this disclosure. In some example embodiments, the air mover system 100 and the coil 212 may be closer, farther, or at different relative positions (e.g., laterally adjacent to each other, etc.) than shown without departing from the scope of this disclosure. In some example embodiments, the locations of the blower control unit 102 and the blower 104 with respect to each other may be different than shown without departing from the scope of this disclosure. For example, the blower control unit 102 and the blower 104 may be laterally adjacent to each other. As another example, the blower control unit 102 may be below the blower 104. In general, the blower controller unit 102 and the blower 104 may be positioned in any suitable relative locations with respect to each other without departing from the scope of this disclosure. In some example embodiments, the blower control unit 102 may be physically attached to the blower 104 without departing from the scope of this disclosure.

Figure 4:
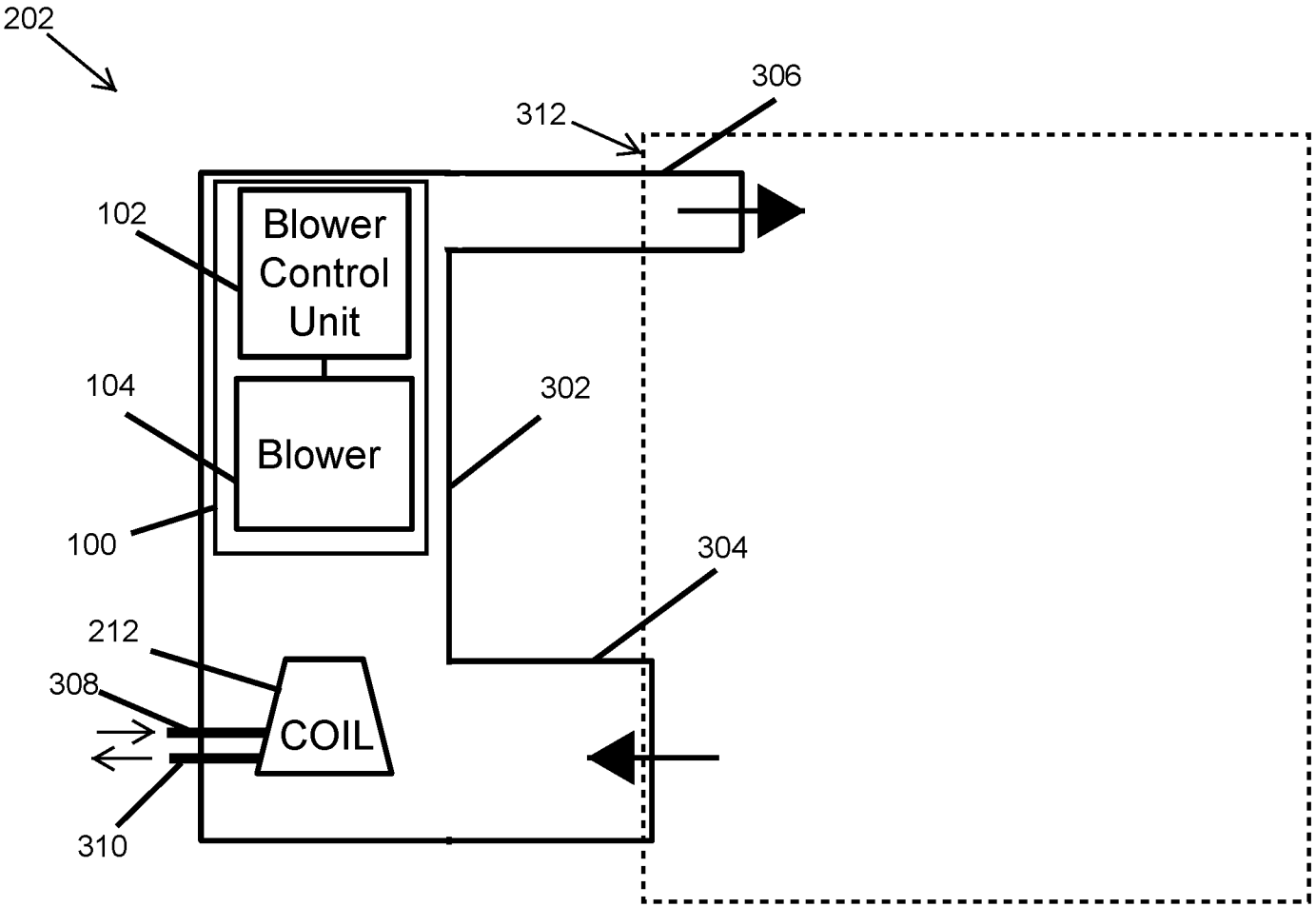
FIG. 4 illustrates the indoor unit of FIG. 2 including the air mover system according to another example embodiment.

FIG. 4 illustrates the indoor unit 202 of FIG. 2 including the air mover system 100 according to another example embodiment. Referring to FIGS. 1, 2, and 4, in some example embodiments, the indoor unit 202 may include the housing 302 that houses the air mover system 100 and the coil 212. The coil 212 may be coupled to refrigerant pipes 308, 310. For example, the pipe 308 may carry a refrigerant to the coil 212, and the pipe 310 may carry the refrigerant from the coil 212.

In some example embodiments, the housing 302 may be coupled to the return air duct 304 and to the outflow duct 306. For example, the air in a space that is air conditioned by the HVAC system 200 may flow into the indoor unit 202 through the intake duct 304 and flow back to the space through the outflow duct 306 after pass by the coil 212. The air may also be filtered inside the indoor unit 202 before flowing out through the outflow duct 306.

As shown in FIG. 4, in some example embodiments, the coil 212 may be positioned below the air mover system 100 including the blower control unit 102 and the blower 104. For example, the blower 104 may suck in air through the intake duct 304 and blow the air out through the outflow duct 306 when operating in cooling, heating, and air circulating modes. In contrast to FIG. 3, In FIG. 4, as the air is sucked in through the intake duct 304, the air passes by the coil 212 before reaching the air mover system 100. When operating in a cooling or heating mode, the air may be cooled or heated by the coil 212 by virtue of the refrigerant flowing through the coil 212.

In some cases, the air inside the indoor unit 202 may include a refrigerant that has leaked from the coil 212, the pipes 308, 310, etc. When the indoor unit 202 is not actively operating during relatively short or long time periods, the blower 104 may not blow the air including the leaked refrigerant out of the indoor unit 202 through outflow duct 306. In such cases, the leaked refrigerant in the air may flow towards the blower control unit 102 that includes the sensor 110, and the sensor 110 may sense the refrigerant and provide to the controller 108 sensor information indicating the presence of the refrigerant. In response to determining that the sensor information indicates the presence of a refrigerant in the air inside the indoor unit 202, the controller 108 may control (e.g., power on) the blower 104 to blow the air out of the indoor unit 202 through the outflow duct 306 to dissipate the refrigerant into the air conditioned space 312. The dissipation of the leaked refrigerant out of the indoor unit 202 may significantly reduce risks, such as the risk of fire if the refrigerant is flammable or risks from toxins in the refrigerant at high concentrations. The controller 108 may also provide a notification, for example, through the annunciator 216 indicating the detection of the refrigerant. The controller 108 may also control, directly or through the main control unit 204, the outdoor unit 206 to turn off or keep the outdoor unit 206 off in response to the detection of the refrigerant in the air inside the indoor unit 202. For example, in some cases, turning off the outdoor unit 206 or keeping the outdoor unit 206 off may reduce the amount of refrigerant leakage in the indoor unit 202.

In some example embodiments, because a leaked refrigerant that is in the air inside the indoor unit 202 may not flow or move from the leak location at or near the coil 212 toward the sensor 110 of the blower control unit 102, particularly when the blower 104 is not off, the blower control unit 102 may control the blower 104 to suck the air toward the sensor 110, which is the same direction as the direction of air flow during normal heating and cooling operations. As described above with respect to FIG. 1, the blower control unit 102 may, for example, periodically or at different times, control the blower 104 to suck the air inside the indoor unit 202 toward the sensor 110. The blower control unit 102 may also control the blower 104 to suck the air, including any leaked refrigerant, inside the indoor unit 202 from the coil 212 toward the sensor 110 at a slower flow rate than the air flow rate during normal cooling or heating operations when the air is being suck from the coil 212 toward the blower 104. For example, sucking the air at a slower flow rate may allow the sensor 110 to more reliably sense leaked refrigerant in the air inside the indoor unit 202. As described above, the blower control unit 102 may control the blower 104 to operate at a lower speed/rate for a sensing time interval.

In some example embodiments, the indoor unit 202 may include other components without departing from the scope of this disclosure. In some alternative embodiments, the blower control unit 102 and the blower 104 may be in a different configuration or orientation than shown without departing from the scope of this disclosure. In some alternative embodiments, the intake duct 304 and the outflow duct 306 may be at different locations than shown without departing from the scope of this disclosure. In some example embodiments, the air mover system 100 and the coil 212 may be closer, farther, or at different relative positions (e.g., laterally adjacent to each other) than shown without departing from the scope of this disclosure. In some example embodiments, the locations of the blower control unit 102 and the blower 104 relative to each other may be different than shown without departing from the scope of this disclosure. For example, the blower control unit 102 and the blower 104 may be laterally adjacent to each other. As another example, the blower control unit 102 may be below the blower 104. In general, the blower controller unit 102 and the blower 104 may be positioned in any suitable relative locations with respect to each other without departing from the scope of this disclosure. In some example embodiments, the blower control unit 102 may be physically attached to the blower 104 without departing from the scope of this disclosure.

Figure 5:
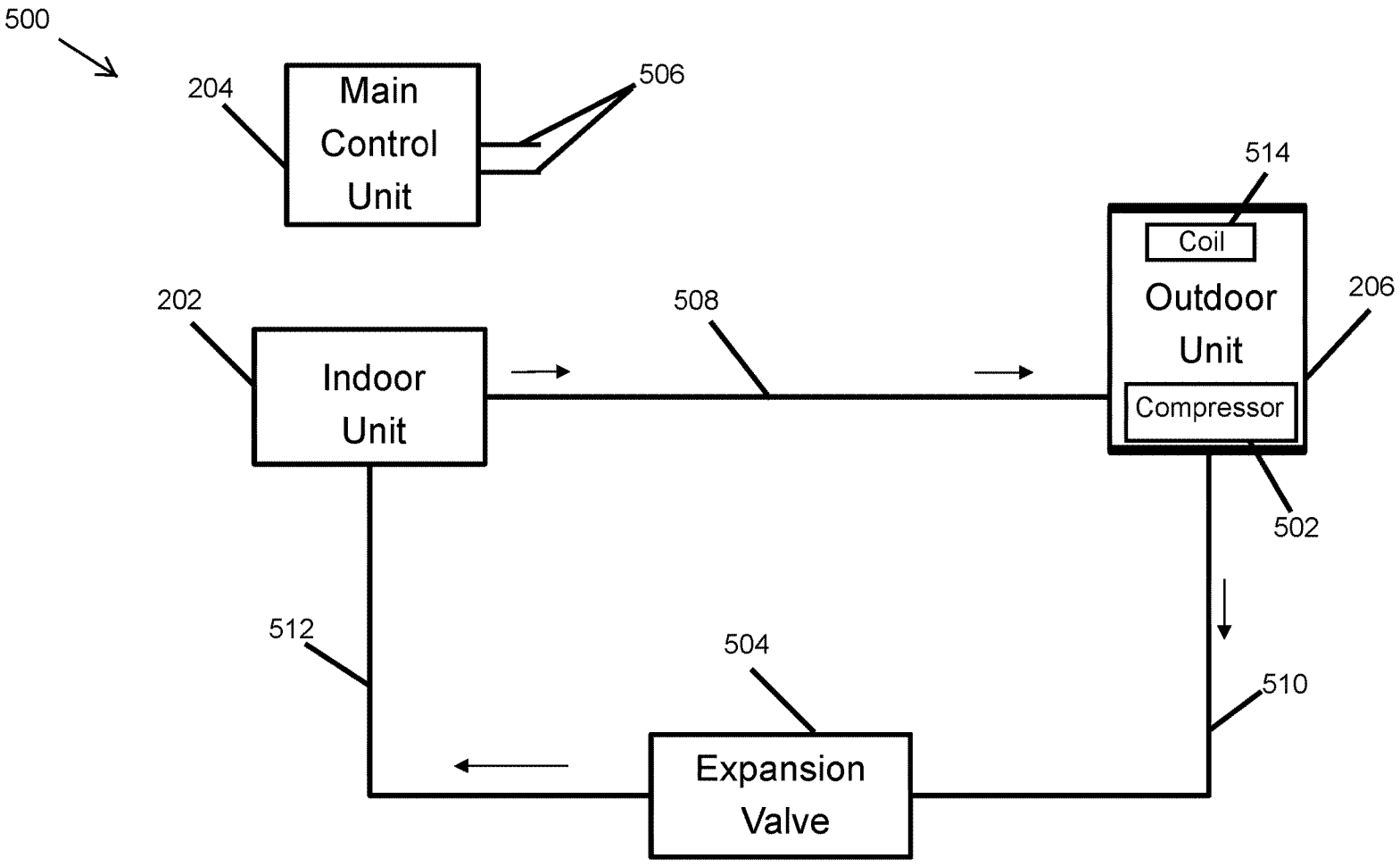
FIG. 5 illustrates an air conditioning system including the indoor unit of FIG. 2 according to an example embodiment.

FIG. 5 illustrates an air conditioning system 500 including the indoor unit 202 of FIG. 2 according to an example embodiment. Referring to FIGS. 1-5, in some example embodiments, the air conditioning system 500 includes the indoor unit 202, the outdoor unit 206, and the main control unit 204. The outdoor unit 206 may include a compressor 502 and a coil 514. The air conditioning system 500 may also include an expansion valve 504 that is fluidly coupled to the indoor unit 202 and the outdoor unit 206.

In some example embodiments, the indoor unit 202 may be fluidly coupled to the outdoor unit 206 via a pipe 508. The outdoor unit 206 may be fluidly coupled to the expansion valve 504 via a pipe 510. The expansion valve 504 may be fluidly coupled to the indoor unit 202 via a pipe 512. For example, a refrigerant may flow through the air conditioning system 500 as shown by the arrows adjacent to the pipes 508-512 when the air conditioning system 500 is operating to cool a space such as room/rooms in a building.

In some example embodiments, the main control unit 204 may communicate with the indoor unit 202, the outdoor unit 206, and other system components, such as sensors, a thermostat, etc. The main control unit 204 may also control some operations of the indoor unit 202 and the outdoor unit 206. For example, the main control unit 204 may control whether the compressor 502 is powered on or off, for example, based on inputs from the sensor 208, the thermostat 210, the controller 108 of the indoor unit 202, etc. The main control unit 204 may communicate and control the various system components including the indoor unit 202 and the outdoor unit 206 via one or more electrical connections 506 (e.g., one or more electrical cables). In some example embodiments, the main control unit 204 may communicate and control some system components wirelessly as can be readily understood by those of ordinary skill in the art with the benefit of this disclosure.

In some example embodiments, the main control unit 204 may control the operation of the expansion valve 504. In general, the expansion valve 504 operates in a manner known to those of ordinary skill in the art with the benefit of this disclosure.

In some example embodiments, the air mover system 100 of the indoor unit 202 operates as described above to dissipate leaked refrigerant out of the indoor unit 202 into an air conditioned space. As described above, the main control unit 204 may communicate with the controller 108 of the air mover system 100 to control some operations of the indoor unit 202, and the controller 108 may communicate with the main control unit 204 to power off or keep off the outdoor unit 206, for example, upon the detection of leaked refrigerant inside the indoor unit 202 and/or based on sensing by the sensor 214, when present, that may be outside of the indoor unit 202.

In some alternative embodiments, the air conditioning system 500 may include other components without departing from the scope of this disclosure. In some alternative embodiments, the compressor 502 may be located outside of the outdoor unit 206 without departing from the scope of this disclosure.

Figure 6:
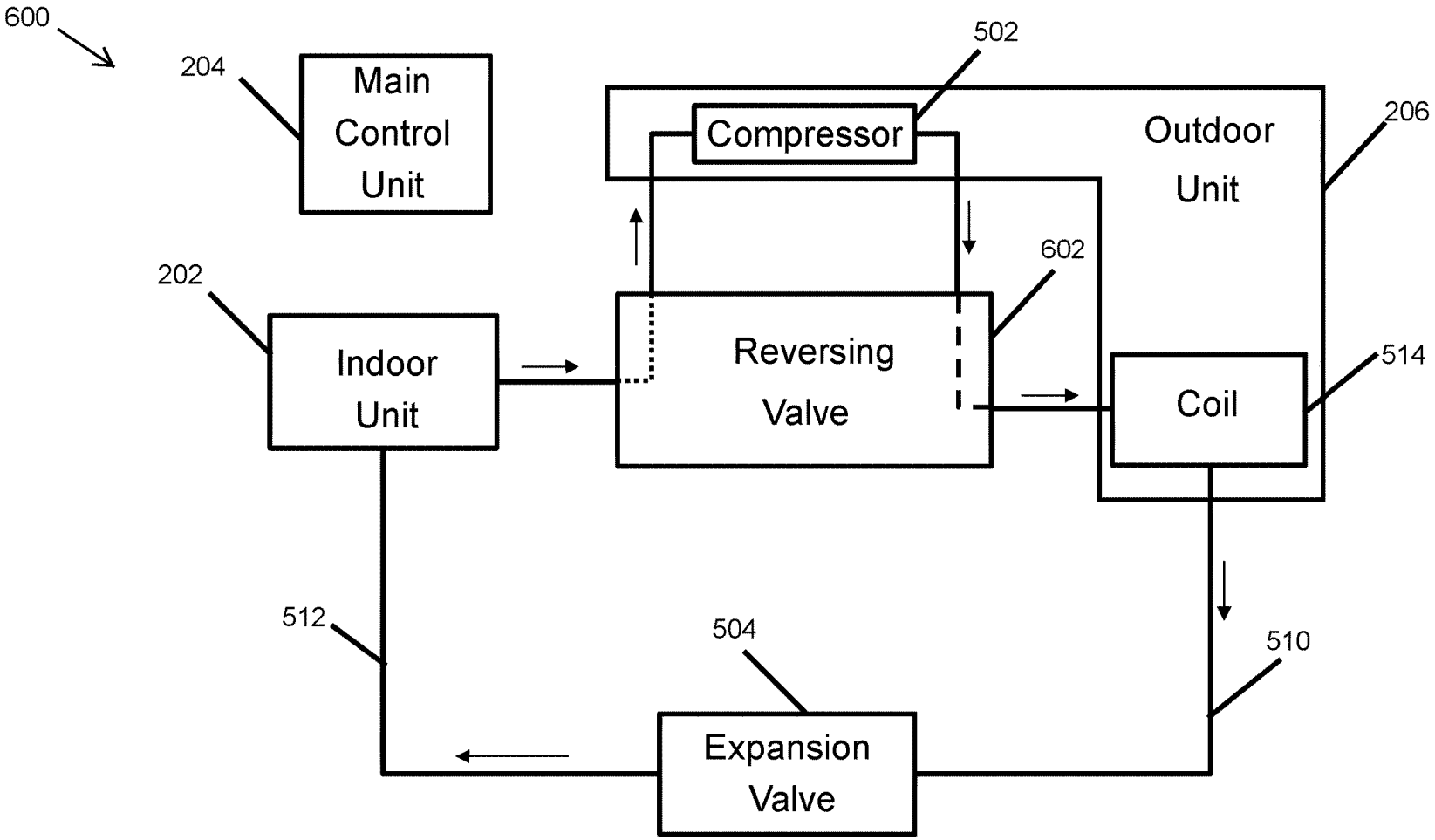
FIG. 6 illustrates a heat pump system including the indoor unit of FIG. 2 according to an example embodiment.

FIG. 6 illustrates a heat pump system 600 including the indoor unit 202 of FIG. 2 according to an example embodiment. Referring to FIGS. 1-4 and 6, in some example embodiments, the heat pump system 600 includes the indoor unit 202, the outdoor unit 206, and the main control unit 204. The heat pump system 600 may also include a reversing valve 602 and the expansion valve 504 that is fluidly coupled to the indoor unit 202 and the outdoor unit 206. The outdoor unit 206 may include the compressor 502 and the coil 514.

As shown in FIG. 6, the heat pump system 600 is configured to operate in a cooling mode. The heat pump system 600 may be configured to operate in a heating mode as can be readily understood by those of ordinary skill in the art with the benefit of this disclosure.

In some example embodiments, the indoor unit 202 may be fluidly coupled to the input port of the compressor 502 of the outdoor unit 206 through the reversing valve 602, and the discharge port of the compressor 502 of the outdoor unit 206 may be fluidly coupled to the coil 514 of the outdoor unit 206. The coil 514 of the outdoor unit 206 may be fluidly coupled to the expansion valve 504 via the pipe 510. The expansion valve 504 may be fluidly coupled to the indoor unit 202 via the pipe 512. When the heat pump system 600 is operating in a cooling mode, a refrigerant may flow through pipes of the heat pump system 600 as shown by the arrows adjacent to the pipes. When the heat pump system 600 is operating in a heating mode, the refrigerant may flow in an opposite direction.

In some example embodiments, the main control unit 204 may communicate with the indoor unit 202, the outdoor unit 206, and other system components, such as sensors, a thermostat, etc. The main control unit 204 may also control some operations of the indoor unit 202 and the outdoor unit 206. For example, the main control unit 204 may control whether the compressor 502 is powered on or off, for example, based on inputs from the sensor 208, the thermostat 210, the controller 108 of the indoor unit 202, etc. As another example, the main control unit 204 may control the reversing valve 602 based on the operation mode of the heat pump system 600. The main control unit 204 may communicate and control the various system components including the indoor unit 202 and the outdoor unit 206 via one or more electrical connections 506 (e.g., one or more electrical cables). In some example embodiments, the main control unit 204 may communicate and control some system components wirelessly as can be readily understood by those of ordinary skill in the art with the benefit of this disclosure.

In some example embodiments, the main control unit 204 may control the operation of the expansion valve 504. In general, the expansion valve 504 operates in a manner known to those of ordinary skill in the art with the benefit of this disclosure.

In some example embodiments, the air mover system 100 of the indoor unit 202 operates as described above to dissipate leaked refrigerant out of the indoor unit 202 into an air conditioned space, such as the space 312. As described above, the main control unit 204 may communicate with the controller 108 of the air mover system 100 to control some operations of the indoor unit 202, and the controller 108 may communicate with the main control unit 204 to power off or keep off the outdoor unit 206, for example, upon the detection of leaked refrigerant inside the indoor unit 202 and/or based on sensing by the sensor 214, when present, that may be outside of the indoor unit 202.

In some alternative embodiments, the heat pump system 600 may include other components without departing from the scope of this disclosure. In some alternative embodiments, the compressor 502 may be located outside of the outdoor unit 206 without departing from the scope of this disclosure.

Figure 7:
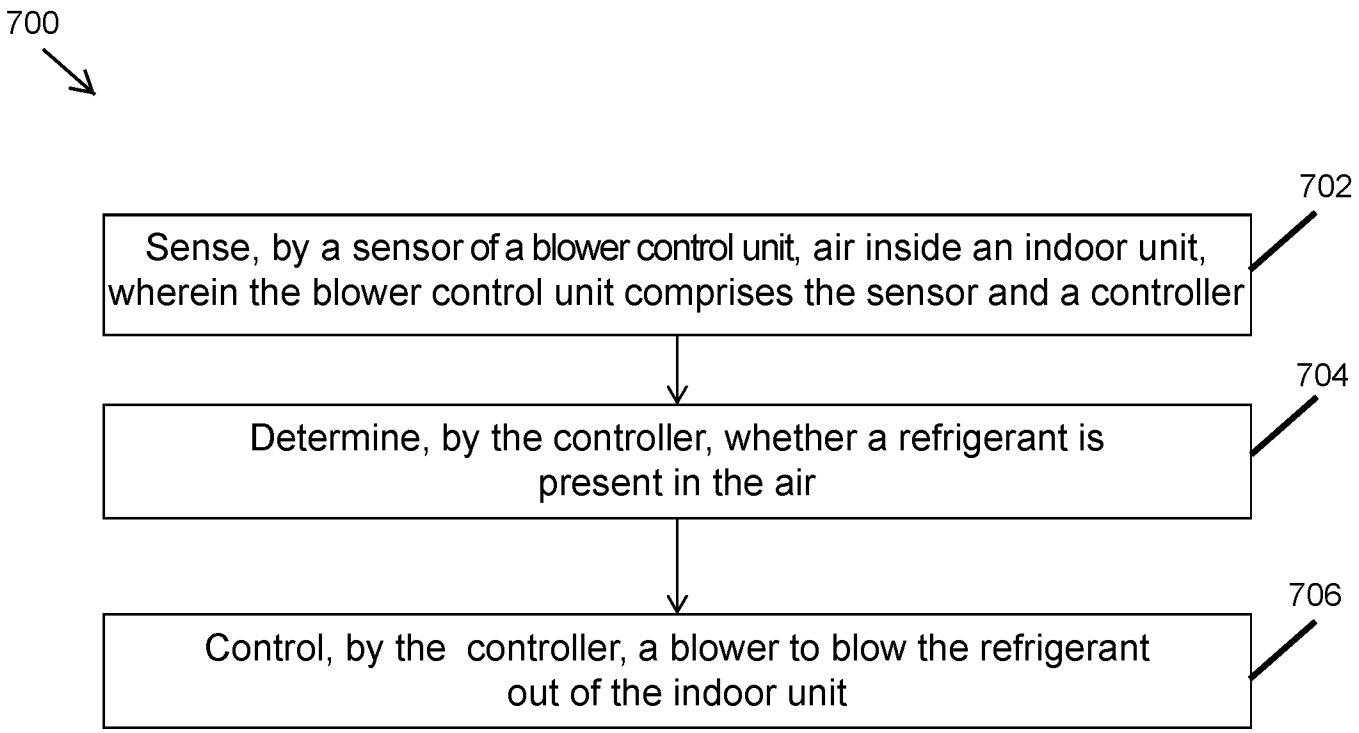
FIG. 7 illustrates a method of operating an HVAC system to detect and dissipate leaked refrigerant according to an example embodiment.

FIG. 7 illustrates a method 700 of operating an HVAC system, such as the HVAC system 200, to detect and dissipate leaked refrigerant according to an example embodiment. Referring to FIGS. 1-7, in some example embodiments, the method 700 includes, at step 702, sensing, by a sensor of a blower control unit, air inside an indoor unit, where the blower control unit includes the sensor and a controller. For example, the sensor 110 of the blower control unit 102 may sense the air inside the indoor unit 202. As explained above, the blower control unit 102 includes the controller 108 and the sensor 110 that may be attached/mounted to the same circuit board. Alternatively, the blower control unit 102 may include separate circuit boards that are attached to each other, for example, using connectors, where the controller 108 is mounted on one of the circuit boards and the sensor 110 is mounted on another one of the circuit boards.

In some example embodiments, at step 704, the method 700 includes determining, by the controller, whether a refrigerant is sensed in the air by the sensor. To illustrate, the controller 108 may receive sensor information that indicates the presence of a refrigerant in the air inside the indoor unit 202. For example, the amount of refrigerant that needs to be in the air for the sensor 110 to sense the refrigerant may depend on the sensitivity of the sensor 110. The sensitivity of the sensor 110 may be set/adjusted such that the sensor 110 can sense the refrigerant when the refrigerant is present in the indoor unit 202 at a particular concentration. In some cases, the sensor information may indicate the presence of the refrigerant in the air if any amount of refrigerant is sensed by the sensor 110. Alternatively, the sensor information may indicate the presence of the refrigerant in the air if the sensed refrigerant amount exceeds a threshold. In some example embodiments, the sensor 110 may sense the air for another air element, such as oxygen, and send the sensor information to the controller 108 indicating the presence or absence of the particular air element, where the presence or absence of the particular air element may be indicative of the presence of a refrigerant in the air.

In some example embodiments, at step 706, the method 700 may include controlling, by the controller, a blower to blow the refrigerant out of the indoor unit in response to determining that a refrigerant is present in the air sensed by the sensor 110. For example, the controller 108 may power on the blower 104 to circulate air into and out of the indoor unit 202 such that the air inside the indoor unit 202 including any leaked refrigerant is blown out into the area that is air conditioned by the HVAC system.

In some example embodiments, the method 700 may include other steps including powering off the compressor 502 upon determining, by the controller 108, that a refrigerant is present in the air sensed by the sensor 110. The method 700 may also include providing an audio notification via the annunciator 216 indicating the detection of a refrigerant in response to the determining the refrigerant is sensed by the sensor 110. In some example embodiments, the controller 108 may use sensor information from the sensor 110 as well as the sensor 214 to determine whether the refrigerant is present inside the indoor unit 202. When the sensor 214 is located outside of the indoor unit 202, the controller 108 may provide an audio notification but may not control the blower 104 to move the air inside the indoor unit 202 based on sensor information from the sensor 214. In some example embodiments, the method 700 may include transmitting a refrigerant leak notification to a user wirelessly or via a wired connection.

In some alternative embodiments, the method 700 may include more or fewer steps than described above without departing from the scope of this disclosure. In some example embodiments, some of the steps of the method 700 may be performed in a different order than described above.

Figure 8:
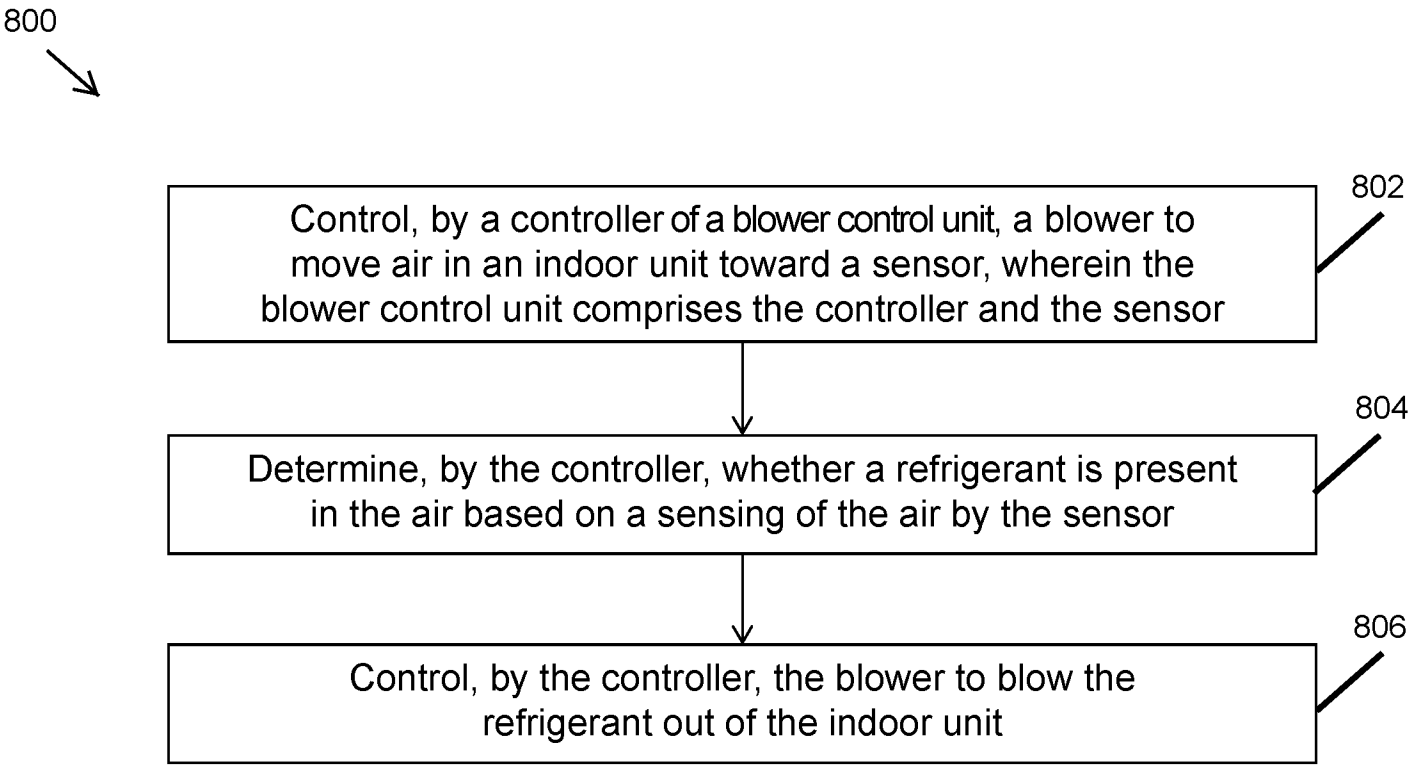
FIG. 8 illustrates a method of operating an HVAC system to detect and dissipate leaked refrigerant according to another example embodiment.

FIG. 8 illustrates a method 800 of operating an HVAC system, such as the HVAC system 200, to detect and dissipate leaked refrigerant according to another example embodiment. Referring to FIGS. 1-6 and 8, in some example embodiments, the method 800 includes, at step 802, controlling, by a controller of a blower control unit, a blower to move air in an indoor unit toward a sensor, where the blower control unit includes the controller and the sensor. For example, the controller 108 of the blower control unit 102 may control the blower 104 to push or suck air inside the indoor unit 202 toward the sensor 110. For example, the controller 108 may power on the blower 104 and control the direction of air flow such that the air inside the indoor unit 202 moves toward the sensor 110 for the sensor 110 to sense the air for a refrigerant or another element in the air indicative of the presence or absence of a refrigerant. The controller 108 may also control the rate of air flow toward the sensor 110 to enable to the sensor to more reliably sense the air for the refrigerant or another air element. The controller 108 may control the blower 104 to move the air toward the sensor 110 for a sensing time period. The controller 108 may also control the blower 104 to move the air toward the sensor 110 at regularly, at particular times, or based on some events such as the powering up of the HVAC system after a long idle period, etc.

As explained above, the blower control unit 102 includes the controller 108 and the sensor 110 that may be attached/mounted to the same circuit board. Alternatively, the blower control unit 102 may include separate circuit boards that are attached to each other, for example, using connectors, where the controller 108 and the sensor 110 are attached to a respective one of the circuit boards.

In some example embodiments, at step 804, the method 800 includes determining, by the controller, whether a refrigerant is present in the air based on a sensing of the air by the sensor. To illustrate, the controller 108 may receive sensor information that indicates the presence of a refrigerant in the air inside the indoor unit 202. For example, the amount of refrigerant that needs to be in the air for the sensor 110 to sense the refrigerant may depend on the sensitivity of the sensor 110. In some cases, the sensor information may indicate the presence of the refrigerant in the air if any amount of refrigerant is sensed by the sensor 110. Alternatively, the sensor information may indicate the presence of the refrigerant in the air if the sensed refrigerant amount exceeds a threshold. In some example embodiments, the sensor 110 may sense the air for another air element, such as oxygen, and send the sensor information to the controller 108 indicating the presence or absence of the particular air element, where the presence or absence of the particular air element may be indicative of the presence of a refrigerant in the air.

In some example embodiments, at step 806, the method 800 may include controlling, by the controller, a blower to blow the refrigerant out of the indoor unit in response to determining that a refrigerant is present in the air sensed by the sensor. For example, in response to determining that a refrigerant is present in the air sensed by the sensor 110, the controller 108 may power on the blower 104 to circulate air into and out of the indoor unit 202 such that the air inside the indoor unit 202, including any leaked refrigerant, is blown out into the area that is air conditioned by the HVAC system.

In some alternative embodiments, the method 800 may include more or fewer steps than described above without departing from the scope of this disclosure. In some example embodiments, some of the steps of the method 800 may be performed in a different order than described above.

In some example embodiments, the method 800 may include other steps including powering off the compressor 502 upon determining, by the controller 108, that a refrigerant is present in the air sensed by the sensor 110. The method 800 may also include providing an audio notification via the annunciator 216 indicating the detection of a refrigerant in response to the determining that refrigerant is sensed by the sensor 110. In some example embodiments, the controller 108 may use sensor information from the sensor 110 as well as the sensor 214 to determine whether the refrigerant is present inside the indoor unit 202. When the sensor 214 is located outside of the indoor unit 202, the controller 108 may provide an audio notification but may not control the blower 104 to move the air inside the indoor unit 202 based on sensor information from the sensor 214. In some example embodiments, the method 800 may include transmitting a refrigerant leak notification to a user wirelessly or via a wired connection.

In some alternative embodiments, the method 800 may include more or fewer steps than described above without departing from the scope of this disclosure. In some example embodiments, some of the steps of the method 800 may be performed in a different order than described above.

Although particular embodiments have been described herein in detail, the descriptions are by way of example. The features of the embodiments described herein are representative and, in alternative embodiments, certain features, elements, and/or steps may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures.

What is claimed is:

1. An air mover system for use in an indoor unit of a heating, ventilation, and air conditioning (HVAC) system, the aft mover system comprising: a blower comprising a motor; and a blower control unit configured to control operations of the motor, the blower control unit comprising: a controller; and a sensor communicably coupled to the controller, wherein the sensor is configured to detect whether a refrigerant is present in air inside the indoor unit and to provide sensor information to the controller, and wherein the controller is configured to: periodically initiate a detection process at a sensing time interval, the detection process including outputting a control signal to control a speed of the motor to cause the blower to move aft in a direction toward the sensor at a flow rate that is less than a flow rate of the air during cooling or heating operations of the indoor unit; determine whether the refrigerant is present in the aft based on the sensor information; and control the blower to move the aft out of the indoor unit in response to determining that the refrigerant is present in the air.

2. The air mover system of claim 1, wherein the direction toward the sensor is opposite from a direction of air flow during heating or cooling operations.

3. The air mover system of claim 1, wherein the sensor is configured to sense the air for an element indicative of whether the refrigerant is present in the air and wherein the element is different from the refrigerant.

4. The air mover system of claim 1, wherein the blower control unit is configured to provide a notification in response to determining that the refrigerant is present in the air.

5. The air mover system of claim 1, wherein the controller and the sensor are attached to a circuit board.

6. An indoor unit of a heating, ventilation, and air conditioning (HVAC) system, the indoor unit comprising: a coil; a blower comprising a motor, wherein the blower draws in or pushes air past the coil during a cooling operation of the HVAC system; and a blower control unit configured to control operations of the motor, the blower control unit comprising a controller and a sensor communicably coupled to the controller, wherein the sensor is configured to detect whether a refrigerant is present in air inside the indoor unit and to provide sensor information to the controller, and wherein the controller is configured to: periodically initiate a detection process at a sensing time interval, the detection process including outputting a control signal to control a speed of the motor to cause the blower to move air in a direction toward the sensor at a flow rate that is less than a flow rate of the air during cooling or heating operations of the indoor unit; determine whether the refrigerant is present in the air based on the sensor information; and control the blower to move the air out of the indoor unit in response to determining that the refrigerant is present in the air.

7. The indoor unit of claim 6, wherein the blower control unit is configured to provide a notification in response to determining that the refrigerant is present in the air.

8. The indoor unit of claim 6, further comprising a second sensor located proximal to the coil, wherein the second sensor is configured to sense an oxygen level of the air inside the indoor unit and to send oxygen level information to the controller.

9. A heating, ventilation, and aft conditioning (HVAC) system, comprising: an outdoor unit; and an indoor unit fluidly coupled to the outdoor unit, wherein the indoor unit comprises: a coil: a blower comprising a motor, wherein the blower draws in or pushes air past the coil during a cooling operation of the HVAC system; and a blower control unit configured to control operations of the motor, the blower control unit comprising a controller and a sensor communicably coupled to the controller, wherein the sensor is configured to detect whether a refrigerant is present in air inside the indoor unit and to provide sensor information to the controller, and wherein the controller is configured to: periodically initiate a detection process at a sensing time interval, the detection process including outputting a control signal to control a speed of the motor to cause the blower to move air in a direction toward the sensor at a flow rate that is less than a flow rate of the air during cooling or heating operations of the indoor unit; determine whether the refrigerant is present in the air based on the sensor information; and control the blower to move the air out of the indoor unit in response to determining that the refrigerant is present in the air.

10. The HVAC system of claim 9, wherein the blower control unit is configured to provide a notification in response to determining that the refrigerant is present in the air.

11. The air moving system of claim 1, wherein the controller controls the blower to move the air out of the indoor unit at a flow rate that is greater than the flow rate of the air during the detection process.

12. The indoor unit of claim 6, wherein the direction toward the sensor is opposite from a direction of air flow during heating or cooling operations.

13. The indoor unit of claim 6, wherein the sensor is configured to sense the air for an element indicative of whether the refrigerant is present in the air and wherein the element is different from the refrigerant.

14. The HVAC system of claim 9, wherein the direction toward the sensor is opposite from a direction of air flow during heating or cooling operations.

15. The HVAC system of claim 9, wherein the sensor is configured to sense the air for an element indicative of whether the refrigerant is present in the air and wherein the element is different from the refrigerant.

* * * * *